US009618229B2

(12) United States Patent
Shiborino

(10) Patent No.: US 9,618,229 B2
(45) Date of Patent: Apr. 11, 2017

(54) HEAT EXCHANGE DEVICE HAVING DUAL HEAT EXCHANGERS

(75) Inventor: Yoshinobu Shiborino, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 525 days.

(21) Appl. No.: 13/643,205

(22) PCT Filed: Apr. 4, 2011

(86) PCT No.: PCT/JP2011/058533
§ 371 (c)(1),
(2), (4) Date: Oct. 24, 2012

(87) PCT Pub. No.: WO2011/135981
PCT Pub. Date: Nov. 3, 2011

(65) Prior Publication Data

US 2013/0037239 A1 Feb. 14, 2013

(30) Foreign Application Priority Data

Apr. 26, 2010 (JP) ..... 2010-101398

(51) Int. Cl.
*F28F 9/00* (2006.01)
*F28F 7/00* (2006.01)
(Continued)

(52) U.S. Cl.
CPC ..... *F24F 13/30* (2013.01); *F24F 1/16* (2013.01); *F28D 1/0435* (2013.01);
(Continued)

(58) Field of Classification Search
CPC ..... F24F 1/16; F24F 13/30; F28F 2009/004; F28D 1/0443; F28D 1/0452; F28D 1/0435; F04D 29/503
(Continued)

(56) References Cited

U.S. PATENT DOCUMENTS 2,980,404 A * 4/1961 Andersen et al. ..... 165/172
3,496,997 A 2/1970 Weber
(Continued)

FOREIGN PATENT DOCUMENTS

JP 50-27232 9/1975
JP 60-108968 U 7/1985
(Continued)

OTHER PUBLICATIONS

Translation of International Patent Document No. WO 2006068210 A1 named Translation—WO 2006068210 A1, translated Jun. 2016.*

*Primary Examiner* — Jianying Atkisson
*Assistant Examiner* — Paul Alvare
(74) *Attorney, Agent, or Firm* — Birch, Stewart, Kolasch & Birch, LLP

(57) ABSTRACT

Provided is a heat exchange device that facilitate assembling of a plurality of heat exchangers. The heat exchange device having a first heat exchanger and a second heat exchanger arranged adjacent to each other so that surfaces of the heat exchangers face each other. A first mounting plate fixed to the side surface of the first heat exchanger, and a second mounting plate fixed to the side surface of the second heat exchanger are fastened and fixed to each other so as to face each other. The first mounting plate has a space of a size such that the second mounting plate can be fixed to the first mounting plate so as to face each other. Insertion holes are formed in the space so as to receive therein tube ends of refrigerant tubes in a plurality of stages, the tube ends laterally projecting from the second mounting plate.

8 Claims, 6 Drawing Sheets

(51) Int. Cl.

| | |
|---|---|
| ***F28D 7/10*** | (2006.01) |
| ***F28D 1/00*** | (2006.01) |
| ***B21D 53/06*** | (2006.01) |
| ***B23P 15/26*** | (2006.01) |
| ***B60K 11/04*** | (2006.01) |
| ***F24F 13/30*** | (2006.01) |
| ***F24F 1/16*** | (2011.01) |
| ***F28D 1/047*** | (2006.01) |
| *F28D 1/04* | (2006.01) |

(52) U.S. Cl.
CPC ..... *F28D 1/0477* (2013.01); *F28F 9/001* (2013.01); *F28D 1/0443* (2013.01); *F28D 1/0452* (2013.01); *F28F 2009/004* (2013.01); *Y10T 29/4935* (2015.01)

(58) Field of Classification Search
USPC ..... 165/67, 76, 78, 140, 149; 180/68.4; 29/890
See application file for complete search history.

(56) References Cited

U.S. PATENT DOCUMENTS

| | | | | |
|---|---|---|---|---|
| 3,616,848 A | | 11/1971 | Kaelin et al. | |
| 4,474,232 A | * | 10/1984 | Wright et al. | 165/137 |
| 5,954,125 A | * | 9/1999 | Mantegazza | B21D 53/085 165/149 |
| 6,206,085 B1 | * | 3/2001 | Correa | 165/67 |
| 6,272,878 B1 | * | 8/2001 | Chang | 62/262 |
| 6,973,960 B1 | * | 12/2005 | Seidel | 165/67 |
| 2002/0050351 A1 | | 5/2002 | Yoshimura et al. | |

FOREIGN PATENT DOCUMENTS

| | | | | | |
|---|---|---|---|---|---|
| JP | 2-71091 A | | 3/1990 | | |
| JP | 3-99134 A | | 4/1991 | | |
| JP | 4-13090 A | | 1/1992 | | |
| JP | 6-35834 U | | 5/1994 | | |
| JP | 9-166389 A | | 6/1997 | | |
| JP | 10-61981 A | | 3/1998 | | |
| JP | 2002-130743 A | | 5/2002 | | |
| JP | 2002-206773 A | | 7/2002 | | |
| JP | 2005-147488 A | | 6/2005 | | |
| JP | 2005-180904 A | | 7/2005 | | |
| JP | WO 2006068210 A1 | * | 6/2006 | | F24F 1/16 |
| JP | 2006-317099 A | | 11/2006 | | |

* cited by examiner

HEAT EXCHANGE DEVICE HAVING DUAL HEAT EXCHANGERS

TECHNICAL FIELD

The present invention relates to a heat exchange device used in an air conditioner.

BACKGROUND ART

As a heat exchange device of this type, Patent Literature 1 discloses a heat exchange device including a first heat exchanger, and a second heat exchanger which has an effective length shorter than the effective length of the first heat exchanger, the heat exchangers being arranged adjacent to each other so as to face each other, the heat exchange device being configured such that an L-shaped first mounting plate bent to the ventilation surface on the front surface side or the rear surface side of the heat-dissipating tins of the first heat exchanger is provided on the side surface of the first heat exchanger, such that an L-shaped second mounting plate, whose portion on the side of the first heat exchanger is bent in the projecting direction of refrigerant tubes, is provided on the side surface of the second heat exchanger, the side surface being on the same side as the first mounting plate, such that an engagement hole and an engagement claw, which are respectively provided at portions where both the mounting plates face each other (portions where both the mounting plates face each other in the ventilation direction), are engaged with each other, and thereby the second heat exchanger is positioned at a different level retreated from the side surface of the first heat exchanger.

Further, Patent Literature 2 discloses an air conditioner in which, in an heat exchanger including a number of heat-dissipating fins arranged in parallel at equal intervals, and refrigerant tubes arranged perpendicularly to the heat-dissipating fins, end portions of the refrigerant tubes are connected to each other by hair-pin shaped (U-shaped) connection tubes, and a side plate made of a steel plate is provided on the side portion of the heat exchanger, and in which the heat exchanger is fixed to a cabinet of the air conditioner and a partition plate in the cabinet by screwing, through through-holes, screws into screw holes of the upper portion of the side plate and the lower portion of the side plate forming the side plate (see paragraph 0017 in the specification of Patent Literature 2).

CITATION LIST

Patent Literature

Patent Literature 1: Japanese Patent Laid-Open No. 2005-147488

Patent Literature 2: Japanese Patent Laid-Open No. 2006-317099

SUMMARY OF INVENTION

Technical Problem

Meanwhile, in the case where the two heat exchangers respectively having effective lengths different from each other are integrally assembled in the state where the ventilation surfaces, each of which is formed by end edges of a number of heat-dissipating fins of each of the two heat exchangers, are made to be arranged adjacent to each other so as to face each other, since the U-shaped connection tubes are brazed to the tube ends of the refrigerant tubes laterally projecting from the mounting plate provided on the side surface of both the heat exchangers, the connection tubes become obstacles, and hence the connecting operations of the mounting plates of both the heat exchangers become complicated.

In the heat exchange device disclosed in Patent Literature 1, the two heat exchangers are attached and fixed at different levels to facilitate the assembling operations of the two heat exchangers, but the heat exchange device is not able to meet the demand that the mounting positions of both the heat exchangers are flush with regard to the respective side surfaces of the two heat exchangers.

In view of the above, it is an object of the present invention to provide a heat exchange device which can facilitate the assembling operations of a plurality of heat exchangers.

Solution to Problem

In order to achieve the above described object, according to the present invention, there is provided a heat exchange device including a first heat exchanger and a second heat exchanger each having a number of heat-dissipating fins arranged in parallel with each other, and refrigerant tubes arranged in a plurality of stages and penetrating the heat-dissipating fins, the heat exchange device being configured such that both the heat exchangers are integrated with each other in the state where the ventilation surfaces are made to be arranged adjacent to each other so as to face each other, and such that both the heat exchangers, which are integrated with each other, can be housed in a cabinet of an air conditioner.

The heat exchange device is configured such that a first mounting plate fixed to the side surface of the first heat exchanger, and a second mounting plate fixed to the side surface of the second heat exchanger are connected and fixed to each other so as to face each other, such that the first mounting plate has a space of a size in which the second mounting plate can be connected and fixed to the first mounting plate so as to face each other, and such that insertion holes, which can receive therein the tube ends of the refrigerant tubes arranged in a plurality of stages in the second heat exchanger, the tube ends laterally projecting from the second mounting plate, are formed in a plurality of stages in the space.

With the configuration described above, the first mounting plate has a space of a size such that the second mounting plate can be connected and fixed to the first mounting plate so as to face each other, and insertion holes are formed in a plurality of stages in the space so as to be able to receive therein the tube ends of the refrigerant tubes arranged in a plurality of stages in the second heat exchanger, the tube ends laterally projecting from the second mounting plate. Therefore, the first mounting plate and the second mounting plate can be connected and fixed to each other so as to face each other by inserting the tube ends of the refrigerant tubes of the second heat exchanger into the insertion holes of the first mounting plate. As a result, the plurality of heat exchangers can be easily assembled by arranging the mounting positions of both the heat exchangers being flush with regard to the respective side surfaces of the two heat exchangers.

At this time, it is preferred that the insertion holes formed in a plurality of stages in the first mounting plate are formed to have a diameter larger than the diameter of the tube end of the refrigerant tube of the second heat exchanger, and that a guide wall for leading the end portion of the refrigerant tube to a predetermined position is formed in at least some of the insertion holes of the insertion holes in a plurality of stages.

In such a configuration, since the insertion holes formed in a plurality of stages in the first mounting plate are formed to have a diameter larger than the diameter of the tube end of the refrigerant tube of the second heat exchanger, even when the tube ends of the refrigerant tubes of the second heat exchanger are projecting from the second mounting plate in a plurality of stages, the tube ends can be easily inserted into the insertion holes of the first mounting plate. Further, the guide wall for leading the tube end of the refrigerant tube of the second heat exchanger to a predetermined position is formed in at least some of the insertion holes in a plurality of stages, and hence the tube end of the refrigerant tube of the second heat exchanger can be positioned easily and correctly at the predetermined position. Thereby, it is possible to easily perform the brazing operation of a U-shaped connection tube, which is performed in a subsequent process.

In this case, in the case where the guide wall is provided in at least some of the insertion holes of the plurality of the insertion holes, even when the guide wall is not provided in all the insertion holes, some of the tube ends of the refrigerant tubes on the side of the second mounting plate are positioned, and the remaining tube ends are positioned so as to follow those positioned tube ends, as a result of which all the tube ends are positioned.

Here, the guide wall of the insertion hole may have any shape as long as the shape of the guide wall is formed so as to enable the tube end of the refrigerant tube to be guided from the large diameter portion of the insertion hole, the portion having a diameter larger than the diameter of the tube end, to the positioning position of the insertion hole. Examples of the guide wall include a guide wall formed so that the large diameter portion leads to an L-shaped hook hole section for positioning, or a guide wall formed in a tapered shape so that the insertion hole becomes thinner from the large diameter portion to a positioning portion of the tube end of the refrigerant tube. In the case of the tapered guide wall, even when the tube end is inserted in the insertion hole in a slightly deviated state, the tube end is moved to a positioning position along the tapered guide wall, and hence can be easily positioned at a predetermined position.

It is preferred that an engagement claw for temporarily fixing both the heat exchangers is formed at either the first mounting plate or the second mounting plate, and an engagement hole engaging with the engagement claw is formed in the other mounting plate. Thereby, the second heat exchanger can be easily temporarily fixed to the first heat exchanger, and the subsequent brazing operation of the U-shaped connection tube can also be suitably performed in the state where the second heat exchanger is prevented from being detached during the operation.

It is preferred that the engagement claw is formed at the side of the tube end of the refrigerant tube projecting from the second mounting plate, and that the engagement hole is cut out and formed in a part of the insertion hole of the first mounting plate. Thereby, the engagement hole and the insertion hole need not be formed separately from each other, and the operation of forming the hole in the first mounting plate can be easily performed. In this case, the engagement hole may be formed in the insertion hole having the guide wall. However, the tube end of the refrigerant tube can also be positioned by the engagement hole and the engagement claw, and hence the guide wall may not be formed in the insertion hole having the engagement hole.

It is preferred that connection holes for connecting and fixing the first mounting plate and the second mounting plate to each other are respectively formed in both the mounting plates, that each of the connection holes is formed so as to allow a connection pin, for fastening both the mounting plates to each other by being inserted into the connection holes, to become in parallel with the tube length direction of the refrigerant tube, and that each of the connection holes is arranged on the outer side in the plate surface direction of each of the mounting plates from the position of the insertion hole of the tube end of the refrigerant tube.

Thereby, the connection direction of both the mounting plates is not the direction perpendicular to the tube end of the refrigerant tube, and hence the connecting operations can be easily performed without contacting with the U-shaped connection tube and without damaging the tube end.

It is preferred that the first mounting plate is set to a size such that both ends of the first mounting plate can be respectively connected and fixed to the cabinet of the air conditioner and the partition plate arranged in the cabinet. Thereby, the first mounting plate can be attached to the structures, such as the cabinet and the partition plate, of the air conditioner, and hence is strengthened as a framework of a structure.

As the above-described cabinet, a cabinet forming the outer wall of an outdoor unit of an air conditioner can be exemplified. Thereby, the cabinet and the heat exchanger of the outdoor unit of the air conditioner can be firmly connected to each other. Further, even when the cabinet is a cabinet which forms the outer wall of an indoor unit of an air conditioner, the same effect can be expected.

The present invention also provides the following assembling method. That is, according to the present invention, there is provided an assembling method in which a first heat exchanger, including a number of heat-dissipating fins arranged in parallel with each other, and refrigerant tubes arranged in a plurality of stages and penetrating the heat-dissipating fins, is assembled and fixed to a cabinet of an air conditioner, and in which, as required, a second heat exchanger including, similarly to the first heat exchanger, a number of heat-dissipating fins arranged in parallel with each other, and refrigerant tubes arranged in a plurality of stages and penetrating the heat-dissipating fins, and the ventilation surface of the first heat exchanger are arranged adjacent to each other so as to face each other, and thereby both the heat exchangers are integrated with each other.

At this time, a first mounting plate fixed to the side surface of the first heat exchanger is formed to have a size such that the first mounting plate can be connected and fixed to structures, such as the cabinet of the air conditioner or the partition plate arranged in the cabinet. The first mounting plate is connected and fixed to the structures, and a second mounting plate is fixed to the side surface of the second heat exchanger. A space is formed of a size such that the second mounting plate can be connected and fixed to the first mounting plate so as to face each other. In the case where the first heat exchanger and the second heat exchanger are integrated with each other in the state where the ventilation surfaces are made to face each other, the insertion holes, which can receive therein the tube ends, are formed in a plurality of stages in the space, in correspondence with the tube ends of the refrigerant tubes in a plurality of stages in the second heat exchanger, the tube ends laterally projecting from the second mounting plate. Thereby, the first mounting plate and the second mounting plate are assembled by being connected and fixed to each other in such a manner that the space portion of the first mounting plate and the second mounting plate of the second heat exchanger are made to face each other, and that the tube ends of the refrigerant tubes of the second heat exchanger are inserted into the insertion holes.

With the above-described assembling method, the first mounting plate of the first heat exchanger and the second mounting plate of the second heat exchanger are assembled by being connected and fixed to each other in such a manner that the tube ends of the refrigerant tubes of the second heat exchanger are inserted into the insertion holes in a plurality of stages in the first mounting plate, and that the space portion of the first mounting plate and the second mounting plate of the second heat exchanger are made to face each other. Therefore, the first heat exchanger and the second heat exchanger can be easily connected and fixed to each other in the state where the side surfaces of both the heat exchangers are aligned to each other.

At this time, it is preferred that the insertion holes formed in a plurality of stages in the first mounting plate are formed to have a diameter larger than the diameter of the tube end of the refrigerant tube of the second heat exchanger, and that a tapered guide wall for leading the end portion of the refrigerant tube to a predetermined position is formed in at least some of the insertion holes of the insertion holes in a plurality of stages, so as to allow the tube end to be easily inserted and guided.

In the case where the second heat exchanger is not integrated with the first heat exchanger and only the first heat exchanger is fixed to the structures, such as the cabinet, the first mounting plate may be used in the state where the insertion holes for receiving therein the tube ends of the second heat exchanger are not formed in the first mounting plate. Thereby, even when it is specified that the number of rows of the heat exchanger is small and that the second heat exchanger is not needed, without forming insertion holes on the first mounting plate, the first mounting plate which has the same shape can be used, and hence the metal mold of the first mounting plate can be used in common.

Advantageous Effect of Invention

As described above, according to the present invention, the first mounting plate has a space of a size such that the second mounting plate can be connected and fixed to the first mounting plate so as to face each other, and in this space, the insertion holes are formed in a plurality of stages so as to be able to receive therein the tube ends of the refrigerant tubes arranged in a plurality of stages in the second heat exchanger, the tube ends laterally projecting from the second mounting plate. Therefore, the first mounting plate and the second mounting plate can be connected and fixed to each other so as to face each other by inserting the tube ends of the refrigerant tubes of the second heat exchanger into the insertion holes of the first mounting plate. As a result, the plurality of heat exchangers can be easily assembled by arranging the mounting positions of both the heat exchangers being flush with regard to the respective side surfaces of the two heat exchangers.

DESCRIPTION OF EMBODIMENTS

Figure 1:
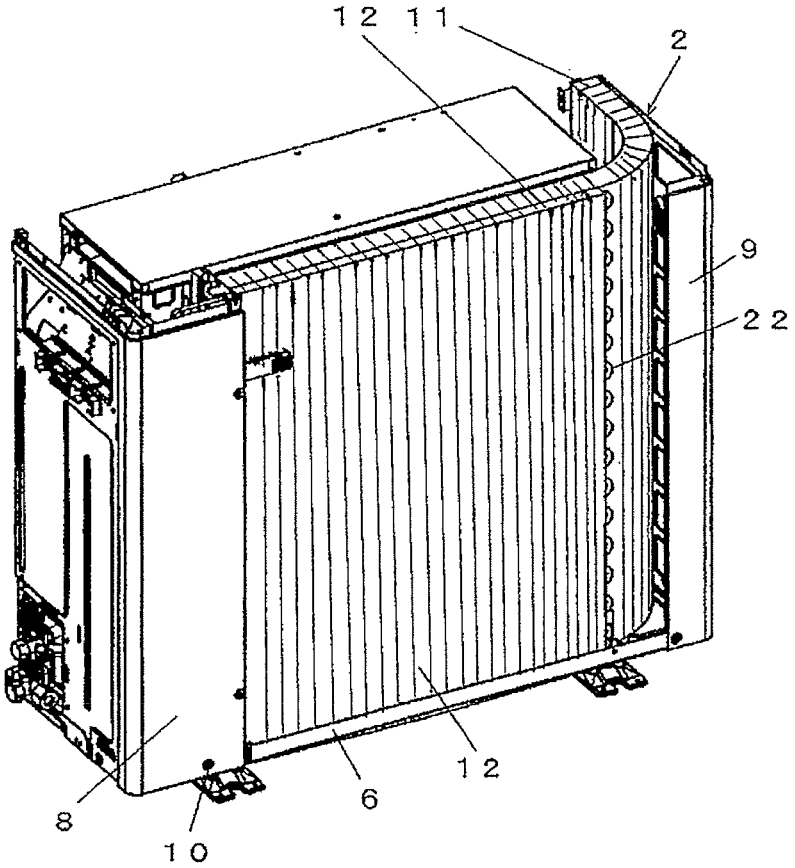
FIG. 1 is an external perspective view of a disassembled outdoor unit of an air conditioner according to the present embodiment.
Figure 2:
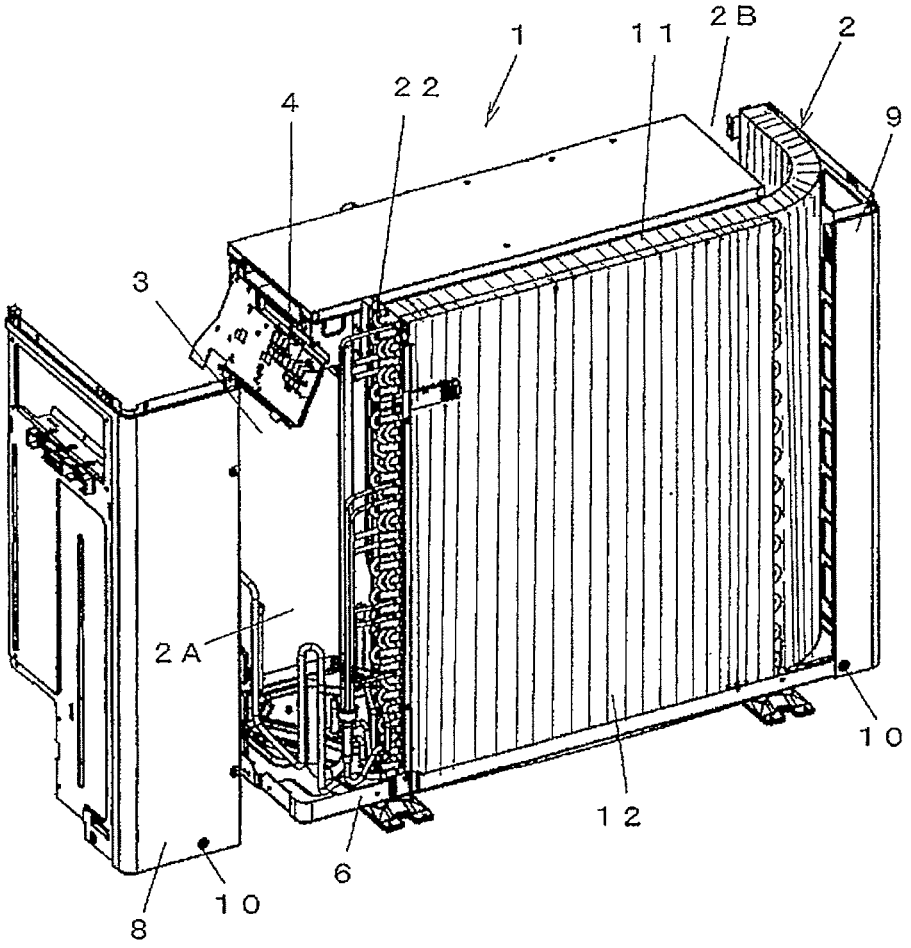
FIG. 2 is an external perspective view of the outdoor unit of FIG. 1, in which the components of the outdoor unit are further disassembled.

An embodiment, in which a heat exchange device according to the present invention is applied to an outdoor unit of an air conditioner, will be described with reference to the accompanying drawings. As shown in FIG. 1 and FIG. 2, an outdoor unit of an air conditioner includes a cabinet 2 forming the outer wall of an outdoor unit 1, and the inside of the cabinet 2 is partitioned by a partition plate 3 into a compressor chamber 2A in which a compressor (not shown) and an electrical component 4 are housed, and a heat exchanger chamber 2B in which a heat exchange device 5 and an air blower (not shown) arranged to face the heat exchange device 5 are housed. The compressor and the heat exchange device 5 are components forming a refrigerating cycle and are connected to each other by a refrigerant tube (not shown).

The cabinet 2 is formed in a box-shape by a bottom plate 6, an upper surface plate (not shown), a front surface panel (not shown), a rear surface panel (not shown), and right and left side surface panels (a right side surface panel 8, and a left side surface panel 9).

Note that in the following description, the side of the front surface panel is set as the front side, and the side of the rear surface panel is set as the rear side, and the direction in which the front surface panel and the rear surface panel face each other is set as the front-rear direction. Further, the side of the right side surface panel is set as the right side, and the side of the left side surface panel is set as the left side, and the direction in which the right side surface panel 8 and the left side surface panel 9 face each other is set as the right-left direction.

The partition plate 3 is arranged on the right side when seen from the front surface side. The compressor chamber 2A is a space surrounded by the partition plate 3, the front surface panel (not shown), and the right side surface panel 8. The heat exchanger chamber 2B is a space surrounded by the partition plate 3, the front surface panel (not shown), the left side surface panel 9, and the rear surface panel. The heat exchange device 5 includes a first heat exchanger 11 and a second heat exchanger 12. The air blower is arranged on the front surface side in the heat exchanger chamber 2B.

The partition plate 3 is vertically provided on the bottom plate 6 and is firmly fixed to the bottom plate 6 by fixing means, such as screws, or by welding. The lower portions of the right and left side surface panels (the right side surface panel 8 and the left side surface panel 9) are firmly fixed to the bottom plate 6 with screws 10. Each of the side surface panels (the right side surface panel 8 and the left side surface panel 9) is suitably bent to the front surface side and/or the rear surface side so as to have a channel shape or an L-shape when seen from the above. The exhaust port of the air blower (not shown) is formed in the front surface panel (not shown), and the air sucked by the air blower from the rear surface side is exhausted to the outside from the exhaust port through ventilation surfaces 11A and 12A of the heat exchange device 5. The rear surface panel (not shown) is formed by a grid-shaped metal mesh, or the like, but the shape is not limited in particular to the mesh shape.

The first heat exchanger 11 and the second heat exchanger 12 are arranged adjacent to each other so that the ventilation surfaces 11A and 12A of the heat exchangers face each other. In this state, both the heat exchangers 11 and 12 are integrated with each other so as to be able to be housed in the heat exchanger chamber 2B of the cabinet 2. More specifically, the rear surface side ventilation surface 11A of the first heat exchanger 11 and the front surface side ventilation surface 12A of the second heat exchanger 12 are arranged adjacent to each other so as to face each other, and thereby the first heat exchanger 11 and the second heat exchanger 12 are integrated with each other so as to be housed in the heat exchanger chamber 2B of the cabinet 2.

As means for integrating the first heat exchanger 11 and the second heat exchanger 12, a first mounting plate 13 is fixed to one side surface of the first heat exchanger 11, and a second mounting plate 14 is fixed to one side surface of the second heat exchanger 12. The first mounting plate 13 and the second mounting plate 14 are connected and fixed to each other so as to face each other in the tube length direction of a refrigerant tube 16. Note that, in FIG. 1 to FIG. 6, each of the first heat exchanger 11 and the second heat exchanger 12 is exemplified as a single heat exchanger, but may be formed by a plurality of heat exchangers.

Each of the first heat exchanger 11 and the second heat exchanger 12 includes a number of heat-dissipating fins 15 arranged in parallel with each other, and the refrigerant tubes 16 which penetrate the heat-dissipating fins 15 and which are arranged in a plurality of stages in the longitudinal direction. The first heat exchanger 11 and the second heat exchanger 12 are respectively provided with the mounting plates 13 and 14, each of which is brought into contact with the heat-dissipating fin 15 on each of the right and left side portions and is attached and fixed to a structure, such as the cabinet.

As shown in FIG. 1, the first heat exchanger 11, the left side end portion of which, when seen from the front surface side, is bent to the front surface side in a substantially L-shape, is housed in the cabinet. In the second heat exchanger 12 provided on the rear surface side of the first heat exchanger 11, refrigerant tubes having a tube length shorter than the tube length of the refrigerant tube 16 of the first heat exchanger 11 are arranged in a plurality of stages in the longitudinal direction.

Note that the heat-dissipating fin 15 and the refrigerant tube 16 are integrated with each other. For example, the refrigerant tube 16 and the heat-dissipating fin 15 are integrated with each other in such a manner that the refrigerant tube 16 is inserted into a through hole (not shown) formed in the heat-dissipating fin 15, and that the diameter of the refrigerant tube 16 is increased by inserting a diameter expansion rod (not shown) into the refrigerant tube 16, so as to make the refrigerant tube 16 press-fixed to the through hole of the heat-dissipating fin 15. Therefore, since it is practically difficult that the two heat exchangers are integrated with each other by simultaneously increasing the diameters of the two refrigerant tubes 16 having different tube lengths, after the two heat exchangers 11 and 12 are respectively molded, both the heat exchangers are integrally fixed to each other by the mounting plates 13 and 14 respectively provided at the side portions thereof.

Here, in FIG. 1, the heat-dissipating fin 15 of the first heat exchanger 11 is formed in a longitudinally long plate shape, and the plate surface direction in the major portion thereof is the front-rear direction. The heat-dissipating fin 15 of the left side portion of the first heat exchanger 11 as a whole is bent to the front surface in a substantially L-shape, and hence the plate surface direction of the heat-dissipating fin 15 is the right and left direction. On the other hand, the refrigerant tube 16, the tube length direction of which is in the direction perpendicular to the plate surface of the heat-dissipating fin 15, is formed in the horizontal direction so as to penetrate the heat-dissipating fin 15. The refrigerant tubes 16 are formed in a plurality of stages in the longitudinal direction of the heat-dissipating fin 15, and in a plurality of rows in the front-rear direction. The number of rows of the refrigerant tubes 16 in the front-rear direction is not limited to the plurality of rows, but may also be a single row.

Further, in the first heat exchanger 11, the front-rear direction end edges of the heat-dissipating fins 15 are collected as if to form one surface, and hence this surface formed by the end edges of the heat-dissipating fins 15 is referred to the ventilation surface 11A. The ventilation surface 11A is formed on both the front surface side and the rear surface side of the first heat exchanger 11. Therefore, in the present embodiment, the wind is made to flow from the rear surface side to the front surface side of the first heat exchanger 11 by operating the air blower. The ventilation surface 12A in the second heat exchanger 12 is also the surface formed by the end edges of the heat-dissipating fins 15, and the ventilation surface 12A is formed on both the front surface side and the rear surface side of the second heat exchanger 12. Therefore, in the present embodiment, the wind is made to flow from the rear surface side ventilation surface to the front surface side ventilation surface of the second heat exchanger 12 by operating the air blower.

Tube ends 16*a* of the refrigerant tubes 16 are respectively formed in a laterally projecting manner so as to penetrate the mounting plates fixed at the right and left side portions of the refrigerant tubes 16. The tube ends are made to communicate with each other and connect to each other in the longitudinal direction or/and the lateral direction by U-shaped connection tubes 22. The tube end 16*a* of the refrigerant tube 16 and the U-shaped connection tube 22 are connected to each other by brazing.

Figure 6:
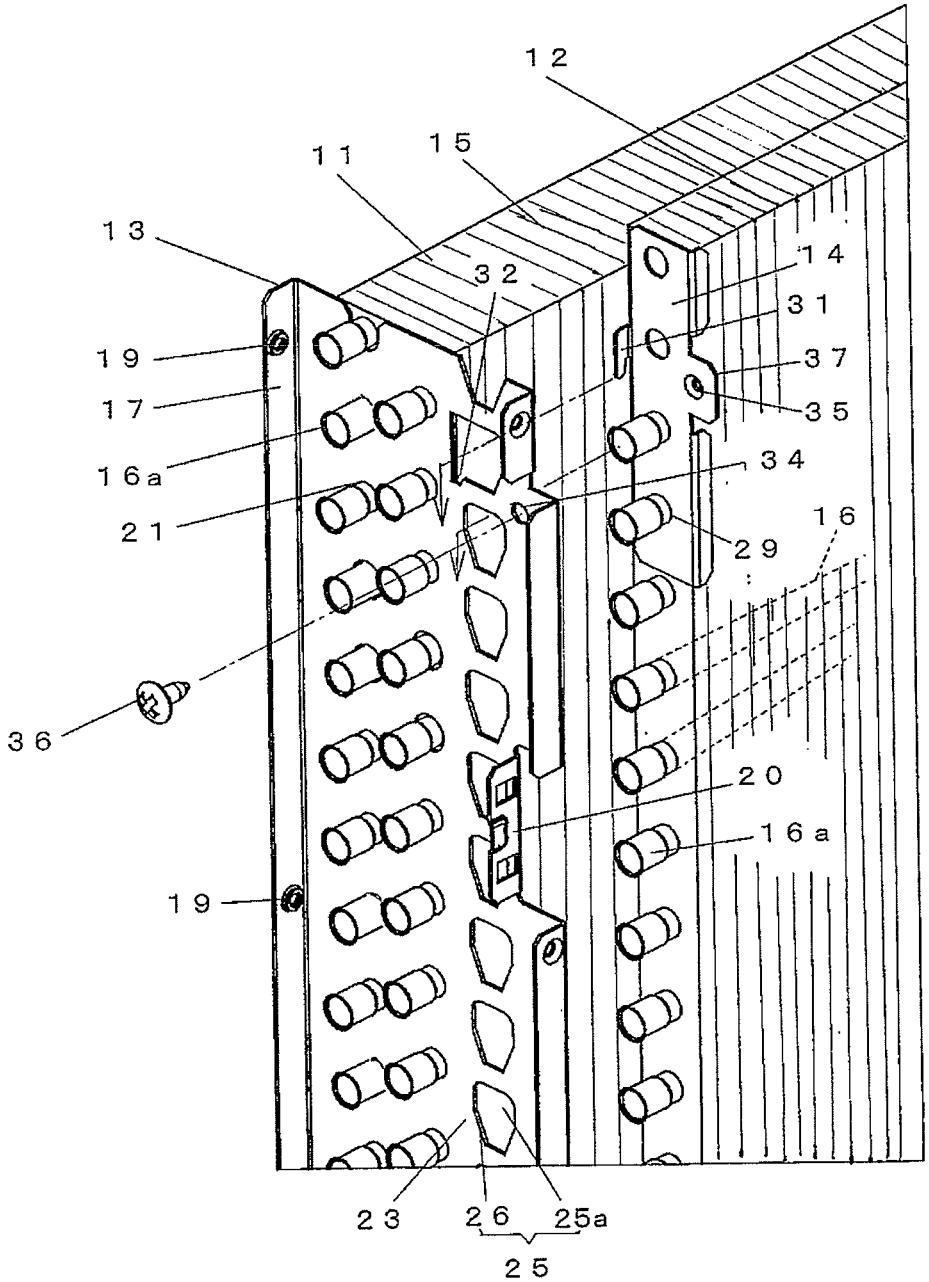
FIG. 6 is an enlarged perspective view showing a state where a first heat exchanger and a second heat exchanger are assembled with each other.

Of the mounting plates respectively attached to both the right and left sides of the first heat exchanger 11, the left side mounting plate (the mounting plate located on the right side in the perspective view seen from the rear surface side in FIG. 1) is firmly fixed to the bottom plate 6 and the left side surface panel 9 by screws. The right side mounting plate (the mounting plate located on the left side in the perspective view seen from the rear surface side in FIG. 1) is, as shown in FIG. 6, formed to have a height equal to the height of the first heat exchanger 11 in the longitudinal direction, so as to form the first mounting plate 13.

The first mounting plate 13 is arranged so that the plate surface direction thereof is in parallel with the heat-dissipating fin 15. Each of the end edges of the plate surface of the first mounting plate 13 is bent toward the outer side in the tube length direction of the refrigerant tube 16 so as to form an L-shaped attachment rib 17, and screw holes 19 for respectively fixing both the ribs 17 to the side surface panels 8 and 9 of the cabinet and to the partition plate 3 are formed in both the ribs 17. Further, a part of the rear surface side end edge of the first mounting plate 13 is cut out and formed, and a part of the wall surface of the cutout section is bent to be a rib-shaped mounting section 20 at which a sensor, such as a temperature sensor, is attached.

First insertion holes 21, into which the two rows of tube ends 16*a* of the refrigerant tubes 16 arranged in a plurality of stages of the first heat exchanger 11 are inserted, are formed on the front portion side of the first mounting plate 13, and the tube end 16*a* of the refrigerant tube 16 is fixed to the first insertion hole 21 in such a manner that, after the tube end 16*a* is inserted into the first insertion hole 21, the diameter of the tube end 16*a* is increased. The U-shaped connection tubes 22 are fixed by brazing to the tube ends 16*a* of the refrigerant tubes.

In the first mounting plate 13, a space 23 is provided on the rear surface side from the U-shaped connection tube 22. The space 23 is formed to have a size such that the second mounting plate 14 can be connected and fixed in the state where the plate surface of the second mounting plate 14 faces the portion of the space 23. Second insertion holes 25, into which the tube ends 16*a* of the refrigerant tubes 16 of the second heat exchanger 12 can be inserted, are formed in this space 23. The second insertion holes 25, which are configured to receive therein the tube ends 16*a* of the refrigerant tubes 16 in a plurality of stages in the second heat exchanger 12, the refrigerant tubes projecting from the second mounting plate 14 in the tube length direction of the refrigerant tube 16, are formed in a plurality of stages in the longitudinal direction.

In the case where the first mounting plate 13 and the second mounting plate 14 are integrated with each other, the integration is performed in such a manner that the front surface side ventilation surface 12A of the second heat exchanger 12 is made to face the rear surface side ventilation surface 11A of the first heat exchanger 11, and that, in this state, the second mounting plate 14 is made to face the first mounting plate 13 by being moved from the tube length direction central side of the refrigerant tube of the first heat exchanger 11 to the tube end side on which the first mounting plate 13 is located, and thereby the tube ends projecting from the second heat exchanger 12 and the second mounting plate 14 are inserted into the second insertion holes 25 of the first mounting plate 13.

Further, the second insertion holes 25 are formed to be larger than the diameter of the tube ends 16*a* of the refrigerant tubes 16 of the second heat exchanger 12, and a guide wall 26, which leads the tube end of the refrigerant tube 16 to a predetermined position, is formed in at least some of the second insertion holes 25 arranged in the plurality of stages.

Among the second insertion holes 25 shown in FIG. 6, each of the second insertion holes 25 other than some of the vertically arranged second insertion holes 25 has a large diameter portion 25*a* having a diameter larger than the diameter of the tube end of the refrigerant tube 16, and the guide wall 26 which continues to the large diameter portion so as to guide the tube end 16*a* of the refrigerant tube 16 to the predetermined position. In the second insertion hole 25 in which the guide wall 26 is not formed, the formation of the guide wall 26 is omitted, as will be described below, in order to cut out and form a temporary fixing engagement hole 32 by which the first mounting plate 13 and the second mounting plate 14 are temporary fixed to face each other. However, as in this example, the guide wall 26 need not be formed in almost all the second insertion holes 25, and when the guide wall 26 is formed in at least about two of the second insertion holes 25, the tube ends 16*a* of the refrigerant tubes 16 can be guided to the predetermined positions.

Further, the shape of the large diameter portion 25*a* is not limited in particular as long as the diameter of the large diameter portion 25*a* is larger than the diameter of the tube end of the refrigerant tube 16. For example, various shapes, such as a rectangular shape, a circular shape, and an elliptical shape, can be adopted as the shape of the large diameter portion 25*a*. FIG. 6 exemplifies a rectangular large diameter portion. The guide wall 26 is formed in a tapered shape so that the insertion hole becomes thinner toward the positioning position of the tube end of the refrigerant tube 16. The positioning position may be any of the lower and upper ends of the second insertion hole 25, and further may be any of the right and left ends of the second insertion hole 25. In FIG. 6, the large diameter portion 25*a* is set as the upper portion of the second insertion hole 25, and the positioning position is set as the lower end of the second insertion hole 25. As a result, the tapered guide wall 26 is formed so that the insertion hole becomes thinner downward.

Therefore, even when the tube end 16*a* of the refrigerant tube 16 is slightly deviated in the large diameter portion 25*a* of the second insertion hole 25, the tube end 16*a* can be inserted into the second insertion hole 25. Further, even when the tube end 16*a* of the refrigerant tube 16 is inserted into the second insertion hole 25 in a slightly deviated state, the tapered guide wall 26 can move the tube end 16*a* to the lowermost positioning position along the guide wall 26, and hence the tube end 16*a* can be easily positioned at the predetermined position.

Further, the size of the first mounting plate 13 is set so that both ends of the first mounting plate 13 can be respectively connected and fixed to the cabinet 2 and the partition plate 3 arranged in the cabinet 2. The first mounting plate 13 is firmly connected to these structures by the screw holes 19, so as to be strengthened as a framework of a structure.

Figure 3:
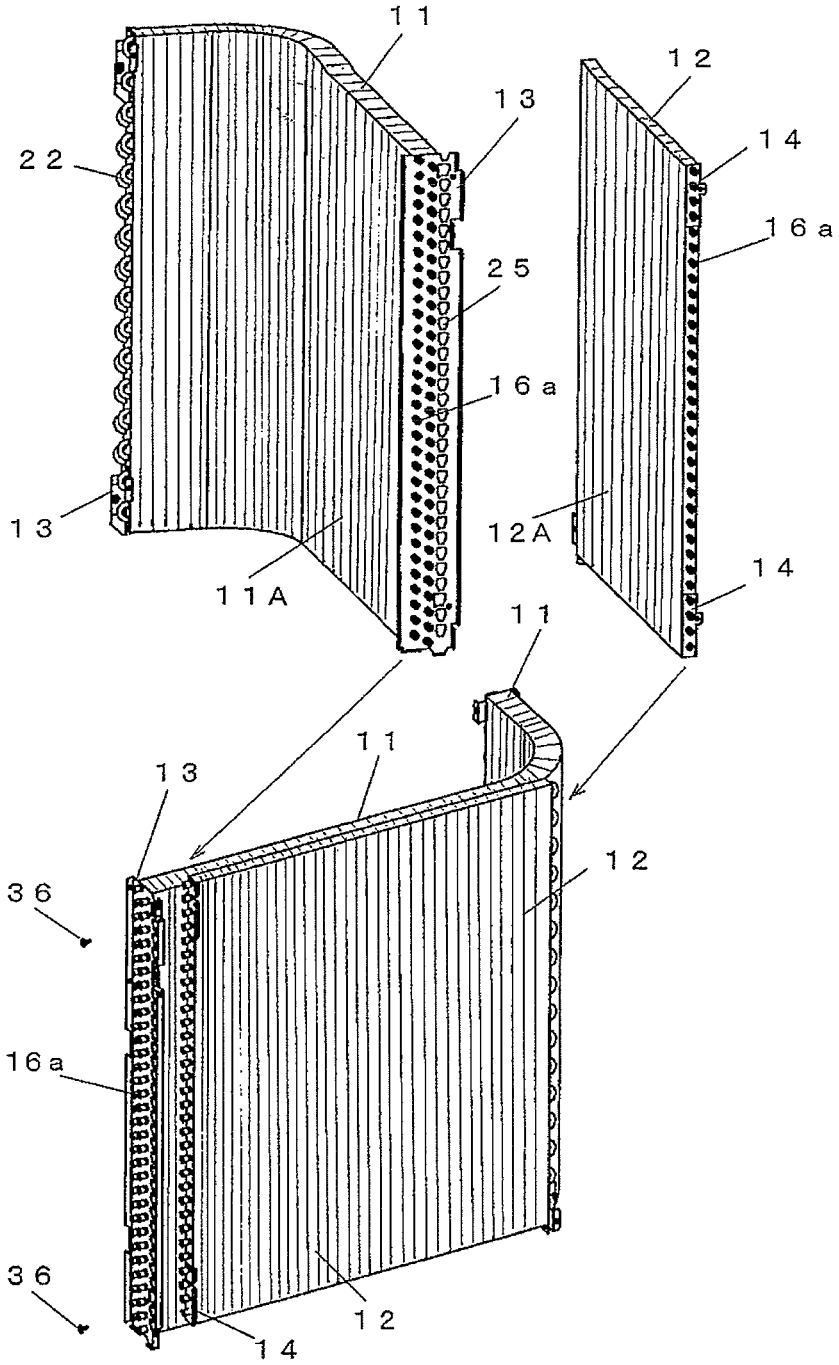
FIG. 3 is a perspective view of heat exchangers for explaining an assembled state of a heat exchange device.

Among the mounting plates attached to both the right and left sides surfaces of the second heat exchanger 12, the mounting plate arranged on the same side as the first mounting plate 13 constitutes the second mounting plate 14. As shown in FIG. 3 and FIG. 6, the second mounting plate 14 is formed to have almost the same size as the plate-surface-direction front-rear width of the heat-dissipating fin 15 of the second heat exchanger 12, and is formed to be vertically divided, so as to have a small longitudinal length. In the example shown in FIG. 3, the longitudinal length of the second mounting plate 14 is set to about a length allowing the insertion and fixation of some four of the tube ends of the refrigerant tubes in a plurality of stages in the second heat exchanger 12, and thereby the material cost is reduced. However, the longitudinal length of the second mounting plate 14 may be longer than that shown in FIG. 3 and FIG. 6. Further, the second mounting plate 14 may not be vertically divided and may be formed in one plate.

Further, in the second mounting plate 14, a plurality of third insertion holes 29, which receive therein the tube ends 16*a* of the refrigerant tubes 16 in a plurality of stages in the second heat exchanger 12, are formed at intervals in the longitudinal direction. After the tube end 16*a* is inserted into the third insertion hole 29, the tube end of the refrigerant tube 16 is fixed to the third insertion hole 29 by increasing the diameter of the tube end. After the tube ends of the refrigerant tubes 16 are inserted into the large diameter second insertion holes 25 of the first mounting plate 13, the U-shaped connection tubes 22 are fixed, by brazing, to the tube ends of the refrigerant tubes 16, and thereby the refrigerant tubes 16 are connected with each other in the longitudinal direction so as to form a part of the refrigerant passage.

Note that there are various connection forms of the connection section of the tube end of the refrigerant tube 16 according to the refrigerant passage formed by the first heat exchanger 11 and the second heat exchanger 12. Therefore, the connection form is not limited to the form in which the tube ends of the refrigerant tubes 16 of the second heat exchanger 12 are connected with each other in the longitudinal direction by the U-shaped connection tubes 22, and the connection form may be a form in which the tube ends of the refrigerant tubes 16 of the second heat exchanger 12 are connected with the tube ends of the refrigerant tubes 16 of the first heat exchanger 11 by the U-shaped connection tubes 22.

An engagement claw 31 is formed for temporarily fixing both the heat exchangers to either the first mounting plate 13 or the second mounting plate 14, and the engagement hole 32, which engages with the engagement claw 31, is formed in the other mounting plate. In the example shown in FIG. 6, the front end of the second mounting plate 14 in the plate surface direction is bent to the outer side of the tube end 16*a* in the tube length direction, so that the engagement claw 31 is formed to be a downward hook shape.

On the other hand, the engagement hole 32 is cut out and formed at the lower end of the highest stage second insertion hole 25 of the first mounting plate 13 so as to face the engagement claw 31. The engagement hole 32 is formed in a narrow groove shape downwardly from the lower end of the second insertion hole 25 so that the hook-shaped engagement claw 31 can engage with the engagement hole 32.

The engagement hole 32 may be formed in a separate position from the second insertion hole 25. Further, the engagement hole 32 and the engagement claw 31 may be formed so as to be able to engage with each other in such a manner that the engagement hole 32 is formed in the second mounting plate 14, and that the engagement claw 31 is formed so as to project from the first mounting plate 13 to the tube central side in the tube length direction.

Further, connection holes 34 and 35 for connecting and fixing the first mounting plate 13 and the second mounting plate 14 to each other are formed in both the mounting plates. Each of the connection holes 34 and 35 is formed so that a connection pin 36, which fastens the first mounting plate 13 and the second mounting plate 14 to each other by being inserted into the connection holes 34 and 35, becomes in parallel with the tube length direction of the refrigerant tube 16. Also, each of the connection holes 34 and 35 is arranged on the outer side and the rear surface side in the plate surface direction of each of the mounting plates 13 and 14 from the position of the second insertion hole 25 of the tube end 16*a* of the refrigerant tube 16.

The connection holes 34 on the side of the first mounting plate 13 are formed on the rear surface side in the plate surface direction of the first mounting plate 13 so that the mounting plates 13 and 14 can be fastened at two upper and lower positions in the longitudinal direction. The connection hole 35 on the side of the second mounting plate 14, which faces the connection hole 34, is formed in a connecting piece 37 formed by projecting, in the front to rear direction of the second mounting plate 14, a part of the connecting piece of the rear surface side in the rear surface direction.

Various connection means, such as a rivet, a bolt, and a screw, can be adopted as the connection pin 36, and a screw is used in the example in FIG. 6. The direction in which the mounting plates 13 and 14 are connected to each other is not a direction perpendicular to the tube end of the refrigerant tube 16. Therefore, the mounting plates 13 and 14 are prevented from being brought into contact with the U-shaped connection tube 22, and hence the connecting operations of the mounting plates 13 and 14 can be easily performed without damaging the tube end 16*a*.

Next, the assembling method of the heat exchange device in the outdoor unit will be described. First, the outline of the assembling method of the heat exchange device of this example is described as follows: The first heat exchanger 11 and the second heat exchanger 12 are integrated with each other in such a manner that the ventilation surfaces of the first heat exchanger 11 and the second heat exchanger 12 are arranged adjacent to each other so as to face each other as required.

In this case, the first mounting plate 13 fixed to the side surface of the first heat exchanger 11 is formed to have a size such that the first mounting plate 13 can be connected and fixed to structures, such as the cabinet of the air conditioner or the partition plate 3 arranged in the cabinet. On the first mounting plate 13 which is connected and fixed to the structures, a space is formed to have a size such that the second mounting plate 14 can be connected and fixed to the first mounting plate 13 so as to face the first mounting plate 13. In the case where the first heat exchanger 11 and the second heat exchanger 12 are to be integrated with each other in the state where the ventilation surfaces of the heat exchangers face each other, both the heat exchangers 11 and 12 are assembled by being connected and fixed to each other in such a manner that the second mounting plate 14 is made to face the space of the first mounting plate 13, and that the tube ends of the refrigerant tubes 16 in a plurality of stages in the second heat exchanger 12 are inserted into the large diameter second insertion holes 25 of the first mounting plate 13.

In this case, the tube end of the refrigerant tube 16 of the second heat exchanger 12 can be easily inserted and guided to be positioned because the second insertion holes 25 formed in a plurality of stages in the first mounting plate 13 are formed to have a diameter larger than the diameter of the tube end of the refrigerant tube 16, and also because the tapered guide wall 26 for leading the end portion of the refrigerant tube 16 to a predetermined position is formed in at least some of the insertion holes of the second insertion holes 25 in a plurality of stages.

Further, in the case where the second heat exchanger 12 is not integrated with the first heat exchanger 11, and only the first heat exchanger 11 is fixed to structures, such as the cabinet, the first mounting plate 13 has a width such that the first mounting plate 13 can be fastened to the cabinet and the partition plate 3, and hence the first mounting plate 13 can be firmly fastened to the structures, such as the cabinet. In this case, the first mounting plate 13 can be used in the state where the insertion holes for receiving therein the tube ends of the second heat exchanger 12 are not formed. Thereby, a molding die of the first mounting plate 13 can be used in common, and hence the production cost can be reduced.

The above is the outline of the assembling method of the heat exchange device, and further the assembling method of the heat exchange device 5 will be described more specifically as follows: First, as shown in FIG. 3, the first heat exchanger 11 and the second heat exchanger 12 are connected to each other in such a manner that, in the state where the tube ends 16*a* of the refrigerant tubes 16 on the side of the first mounting plate 13 and the second mounting plate 14 are opened, the second heat exchanger 12 is arranged adjacent to the rear surface side of the first heat exchanger 11, and then the tube ends 16*a* of the refrigerant tubes 16 of the second heat exchanger 12 are inserted into the large diameter second insertion holes 25 of the first mounting plate 13.

Subsequently, when the second heat exchanger 12 is slightly moved downward so that the engagement claw 31 of the second mounting plate 14 engages with the engagement hole 32 of the first mounting plate 13, the engagement claw 31 of the second mounting plate 14 engages with the engagement hole 32 of the first mounting plate 13, so as to be temporarily fixed.

At this time, when, after the tube ends of the refrigerant tubes 16 of the second heat exchanger 12 are inserted into the large diameter portions 25*a* of the second insertion holes 25 of the first mounting plate 13, the second heat exchanger 12 is slightly moved downward, the tube ends of the refrigerant tubes 16 of the second heat exchanger 12 are moved downward along the tapered guide wall 26, so as to be positioned at predetermined positions. In this state, the first mounting plate 13 and the second mounting plate 14 are made to face each other in the tube length direction of the refrigerant tube 16. Also, the engagement claw 31 of the second mounting plate 14 and the engagement hole 32 of the first mounting plate 13 are temporarily fixed to each other by engaging with each other, and the tube ends 16*a* of the refrigerant tubes 16 of the second heat exchanger 12 are positioned at the predetermined positions after being inserted into the large diameter second insertion holes 25 of the first mounting plate 13.

Then, both the mounting plates 13 and 14 are integrated with each other, when both the mounting plates 13 and 14 are fastened and fixed to each other by the screw 36 being inserted into the connection holes 34 and 35 in the tube length direction, connection holes being provided on the rear surface side of both the mounting plates 13 and 14. In this case, the fastening direction of the screws 36 is the tube length direction of the refrigerant tube 16. Therefore, even when the U-shaped connection tubes 22 exist, the mounting plates 13 and 14 are connected and fixed to each other on the rear surface side of the U-shaped connection tubes 22, and hence the mounting plates 13 and 14 can be easily connected to each other. Thereafter, the U-shaped connection tubes 22 are welded and brazed to the tube ends of the refrigerant tubes 16, so that the tube ends are connected and fixed to each other. Note that the brazing operation of the U-shaped connection tubes 22 may be performed before both the mounting plates 13 and 14 are fixed to each other by the screws 36.

Figure 4:
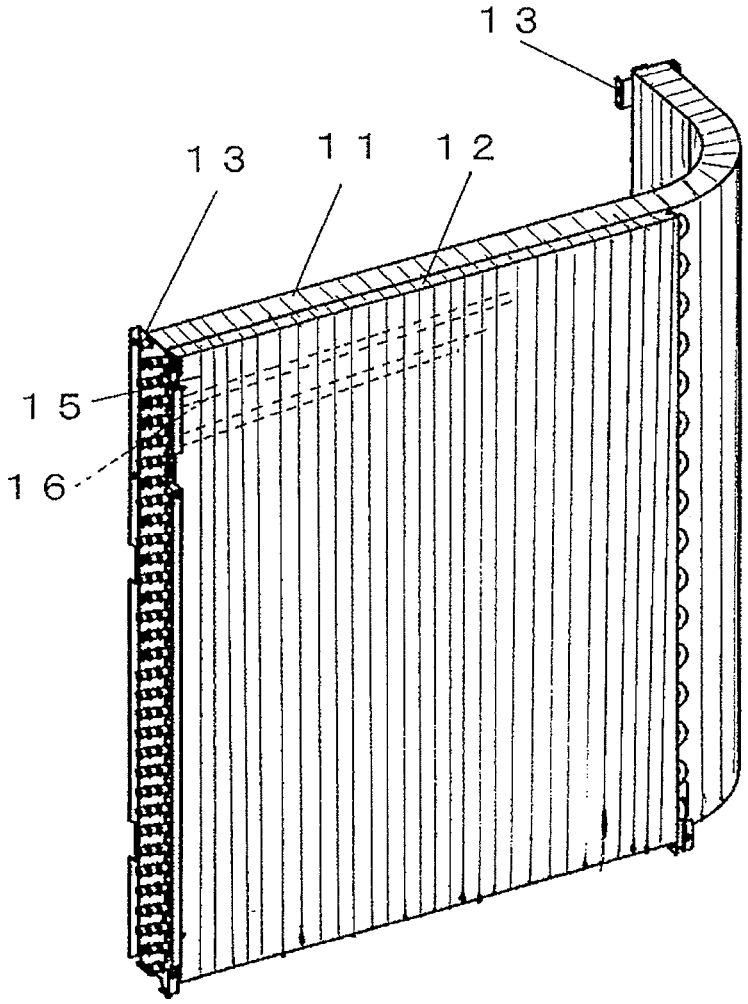
FIG. 4 is a perspective view seen from one direction of the assembled heat exchangers.
Figure 5:
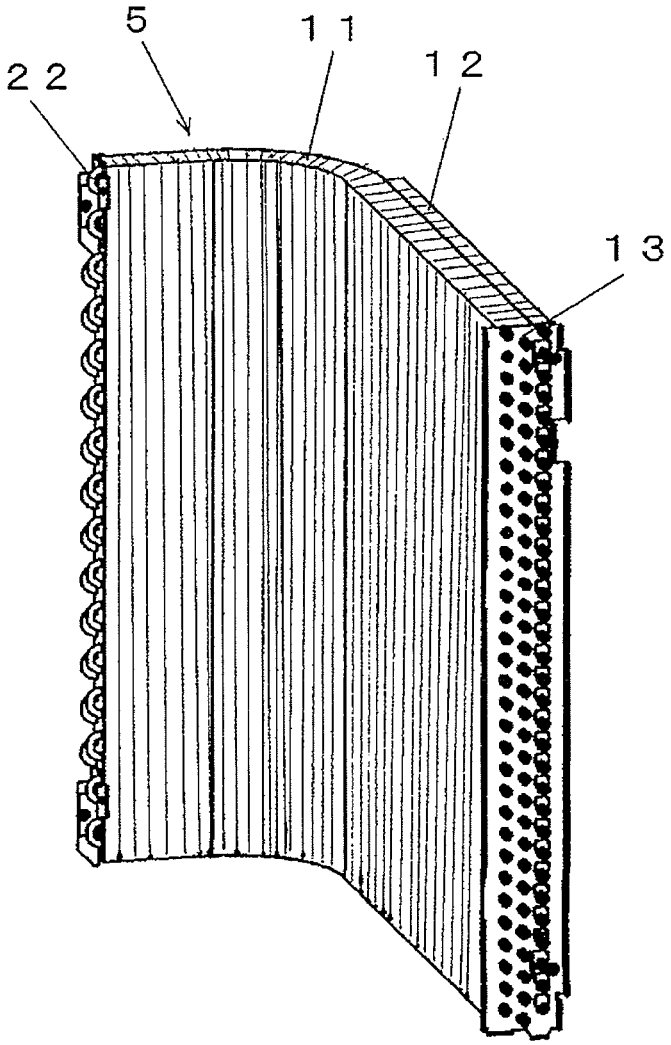
FIG. 5 is a perspective view seen from another direction of the assembled heat exchangers.

FIG. 4 and FIG. 5 show the heat exchange device 5 assembled as described above. The heat exchange device 5 is arranged in the heat exchanger chamber in the cabinet as shown in FIG. 2, and the upper and lower portions of the first mounting plate 13 are fastened and fixed by screws to the right side surface panel 8 and the partition plate 3. Thereby, the second mounting plate 14 faces the first mounting plate 13 so as to be integrated with each other in a large area, and hence the first heat exchanger 11 and the second heat exchanger 12 are firmly integrated with each other. Further, the assembled heat exchangers 11 and 12 are fastened to the bottom plate 6 and the side surface panels (the right side surface panel 8 and the left side surface panel 9) of the cabinet, so as to be integrated with the structures, such as the bottom plate 6 and the side surface panels (the right side surface panel 8 and the left side surface panel 9), and hence an outdoor unit having excellent structural strength can be provided.

Further, in the case where the second heat exchanger 12 is not integrated with the first heat exchanger 11, and only the first heat exchanger 11 is fixed to the structures, such as the cabinet, the first mounting plate 13 is used in the state where the second insertion holes 25 are not formed for receiving therein the tube ends of the second heat exchanger 12. Thereby, when it is specified that the number of rows of heat exchangers is small and that the second heat exchanger 12 is not needed, the second insertion holes 25 need not be formed in the first mounting plate 13, and hence it is possible to use the first mounting plate 13 having the same shape except that the second insertion holes 25 are not formed. Therefore, the same metal mold can be used in common for both the cases where the second insertion holes 25 are formed and are not formed.

As described above, the first mounting plate 13 has a space of a size such that the second mounting plate 14 can be connected and fixed to the first mounting plate 13 so as to face each other. In this space, the large diameter second insertion holes 25 are formed in a plurality of stages so as to be able to receive therein the tube ends of the refrigerant tubes 16 in a plurality of stages in the second heat exchanger 12, the tube ends laterally projecting from the second mounting plate 14. Therefore, the first mounting plate 13 and the second mounting plate 14 can be fastened and fixed to each other so as to face each other by inserting the tube ends of the refrigerant tubes 16 of the second heat exchanger 12 into the large diameter second insertion holes 25 of the first mounting plate 13. Thereby, the plurality of heat exchangers can be easily assembled by arranging the mounting positions of both the heat exchangers being flush with regard to the respective side surfaces of the two heat exchangers.

INDUSTRIAL APPLICABILITY

According to the present invention, the first heat exchanger and the second heat exchanger are housed in the cabinet in the state where the heat exchangers are arranged adjacent to each other so as to face each other. Therefore, the present invention can be applied not only to an outdoor unit of an air conditioner, in which unit a heat exchanger is housed, but also to an indoor unit of an air conditioner.

REFERENCE SIGNS LIST

1 Outdoor unit
2 Cabinet
3 Partition plate
4 Electrical component
5 Heat exchange device
6 Bottom plate
8 Right side surface panel
9 Left side surface panel
10 Screw
11 First heat exchanger
11A Ventilation surface of first heat exchanger
12 Second heat exchanger
12A Ventilation surface of second heat exchanger
13 First mounting plate
14 Second mounting plate
16 Refrigerant tube
16*a* Tube end
17 Attachment rib
20 Sensor mounting section
21 Insertion hole
22 Connection tube
23 Space
25 Insertion hole
25*a* Large diameter portion
26 Guide wall

The invention claimed is:

1. A heat exchange device, comprising a first heat exchanger and a second heat exchanger, the first heat exchanger being positioned in front of the second heat exchanger, the heat exchangers being housed in a cabinet of an air conditioner:

each heat exchanger comprising a number of heat-dissipating fins arranged in parallel with each other, refrigerant tubes arranged in a plurality of stages penetrating the heat-dissipating fins and the mounting plates, and a plurality of U-shaped connection tubes for connecting the tube ends of the refrigerant tubes with each other, wherein the first heat exchanger is bent toward a front surface side in a substantially L-shape, the second heat exchanger is positioned on a rear surface side of the first heat exchanger, and the second refrigerant tubes in the second heat exchanger have a tube length that is shorter than the tube length of the first refrigerant tubes of the first heat exchanger; and wherein a first mounting plate is fixed to a side surface of the first heat exchanger and a second mounting plate is fixed to a side surface of the second heat exchanger, and said first and second mounting plates face each other and are connected and fixed to each other;

the first mounting plate has a first plurality of insertion holes for receiving the refrigerant tubes of the first heat exchanger, the tube ends of the first refrigerant tubes project laterally from the first mounting plate through said first plurality of insertion holes, the tube ends of the second refrigerant tubes project laterally through the second mounting plate, said first mounting plate comprises an area adjacent to said first insertion holes of a size corresponding to the size of said second mounting plate and which faces the second mounting plate and is connected and fixed to the second mounting plate, said area of said first mounting plate having second insertion holes receiving therein the tube ends of the second refrigerant tubes, wherein the diameter of said second insertion holes is larger than the diameter of the second refrigerant tubes and smaller than the distance between the tube ends of the U-shaped connection tubes, wherein the U-shaped connection tubes are brazed and fixed to the tube ends of the refrigerant tubes laterally projecting from the first insertion holes and from the second insertion holes.

2. The heat exchange device according to claim 1, wherein the second insertion holes are formed in a plurality of stages in the first mounting plate to have a diameter larger than the diameter of the second refrigerant tubes of the second heat exchanger, and a guide wall for leading an end portion of the refrigerant tube to a predetermined position is formed in at least some of the second insertion holes.

3. The heat exchange device according to claim 2, wherein the guide wall of the second insertion hole is formed as a tapered shape in which the insertion hole becomes narrower from a large diameter portion to a portion for positioning the tube end of the refrigerant tube.

4. The heat exchange device according to claim 1, further comprising an engagement claw for temporarily fixing both the heat exchangers is formed on either the first mounting plate or the second mounting plate, and an engagement hole engaging with the engagement claw is formed in the other mounting plate.

5. The heat exchange device according to claim 4, wherein the engagement claw is formed on the second mounting plate adjacent to a projecting tube end of a second refrigerant tube, and the engagement hole is cut out and formed in a part of a second insertion hole of the first mounting plate.

6. The heat exchange device according to claim 1, wherein: connection holes for connecting and fixing the first mounting plate and the second mounting plate to each other are respectively formed in both the first and second mounting plates; each of the connection holes receive therein a connection pin which fastens the mounting plates to each other, the connection pin being parallel with the tube length direction of the refrigerant tubes; and each of the connection holes is arranged on the outer side in the plate surface direction of each of the mounting plates from the position of the insertion hole of the tube end of the refrigerant tube.

7. The heat exchange device according to claim 1, wherein the ends of the first mounting plate are connected, respectively, to the cabinet of the air conditioner and to a partition plate arranged in the cabinet.

8. The heat exchange device according to claim 7, wherein the cabinet forms the outer wall of an outdoor unit of an air conditioner.

* * * * *